US007942751B2

(12) United States Patent
Dent

(10) Patent No.: US 7,942,751 B2
(45) Date of Patent: May 17, 2011

(54) SPORTS FACILITY

(76) Inventor: Kyle Graham John Dent, Devon (GB)

( * ) Notice: Subject to any disclaimer, the term of this patent is extended or adjusted under 35 U.S.C. 154(b) by 248 days.

(21) Appl. No.: 12/303,962

(22) PCT Filed: Jun. 8, 2007

(86) PCT No.: PCT/GB2007/002136

§ 371 (c)(1),
(2), (4) Date: Dec. 9, 2008

(87) PCT Pub. No.: WO2007/141546

PCT Pub. Date: Dec. 13, 2007

(65) Prior Publication Data

US 2010/0130297 A1 May 27, 2010

(30) Foreign Application Priority Data

Jun. 9, 2006 (GB) ..... 0611384.9

(51) Int. Cl.
*A63C 19/10* (2006.01)
*A63C 19/00* (2006.01)

(52) U.S. Cl. ..... 472/91; 482/71

(58) Field of Classification Search ..... 472/88–91; 14/69.5, 70; 482/70, 71
See application file for complete search history.

(56) References Cited

U.S. PATENT DOCUMENTS

| | | | | |
|---|---|---|---|---|
| 3,251,596 | A | 5/1966 | Fukusaburo | |
| 4,087,088 | A | 5/1978 | Kelso | |
| 4,423,864 | A * | 1/1984 | Wiik | 472/91 |
| 5,018,721 | A * | 5/1991 | Nagahisa | 472/91 |
| 5,647,804 | A * | 7/1997 | Homma et al. | 472/90 |
| 5,951,357 | A * | 9/1999 | Mandle et al. | 446/138 |
| 7,513,832 | B2 * | 4/2009 | Gallagher | 472/89 |

FOREIGN PATENT DOCUMENTS

| | | |
|---|---|---|
| EP | 0384383 | 8/1990 |
| FR | 1418835 | 11/1965 |
| FR | 2757415 | 6/1998 |
| GB | 2288544 | 10/1995 |
| GB | 2365787 | 2/2002 |
| NL | 9301043 | 6/1993 |
| WO | 95/28997 | 11/1995 |
| WO | 2006/017971 | 2/2006 |

* cited by examiner

*Primary Examiner* — Kien T Nguyen
(74) *Attorney, Agent, or Firm* — The Mueller Law Office, P.C.

(57) ABSTRACT

A sporting facility comprises a plurality of rotary elements having flexible components extending therefrom, the rotary elements being arranged so that the flexible components thereof provide a substantially continuous supporting surface, and means for rotating the rotary elements. The flexible components are preferably filaments or fibers, extending perpendicular to the substantially continuous surface. The facility is of particular use in providing an artificial surface for skiing, snow boarding, surfing or the like.

20 Claims, 9 Drawing Sheets

SPORTS FACILITY

RELATED APPLICATIONS

This application claims priority to International Application Serial No. PCT/GB2007/002136 filed on Jun. 8, 2007, entitled "Sports Facility," which claims priority to British application GB0611384.9, filed on Jun. 9, 2006, entitled "Sports Facility," all of which are hereby incorporated by reference as if set forth in full in this application for all purposes.

BACKGROUND OF THE INVENTION

This invention relates to sport facilities and is concerned with the provision of an improved form of sports facility.

The facilities currently available in many countries, for example the United Kingdom, for skiing, skateboarding and snowboarding and the like are limited, and it is an object of the present inventions to provide a novel form of sports facility that can be used for such sports. Further, the facilities for many sports, such as surfing, are available only in certain parts of the country and, even then, their use is dependent on the weather. A further object of the present invention is the provision of a facility for practicing surfing. In particular, there is a need for a facility having an artificial surface that more closely resembles the natural conditions experienced in such activities as surfing, skiing, snowboarding, skateboarding and the like.

A number of attempts have been made to provide an artificial surface for skiing, snowboarding and the like. U.S. Pat. No. 4,087,088 discloses a moving artificial ski surface construction in which a support surface comprising an energy absorbing base of elastomer is employed. The energy absorbing base is covered by a flexible sheath having a continuous surface. Fibers extend upwards from the surface of the sheath to provide an artificial ski surface. The support surface is arranged to provide a slope. The continuous surface of the sheath forms an endless belt, mounted on rollers. The rollers are driven by a motor to move the continuous surface. While the moving surface may act as an artificial slope for skiing, its form is very limited and is not suitable to providing a range of surface conditions on which a person may ski.

GB 2,288,544 discloses an artificial ski slope having an artificial skiing surface. The surface comprises a plurality of rollers, at least some of which extend at an angle to the notional longitudinal centre line of the slope. The rollers are mounted so as to be freely rotatable, whereby a person passing over the rollers on skis cause the rollers to rotate. It is alleged that this mimics a natural skiing surface and duplicates the skiing experience for the user. The pitch and angle of the rollers may be varied at different locations on the slope to provide a variation in the skiing properties of the surface.

Further, GB 2,365,787 is concerned with a rotary ski slope. The ski slope is formed by the upper surface of a large disc, mounted with its axis tilted to the vertical. A least a portion of the disc is rotatable about the main axis. The disc has a diameter of at least 100 meters, with longer slopes being obtained by using a disc of larger diameter. The disc may be divided into a plurality of concentric rings, which may be stationary or driven at the same or different speeds. It is also proposed to drive the discs in different directions. Generally, the apparatus of GB 2,365,787 is very large and cumbersome, being unsuited for use in locations where space is limited. In addition, as with other known systems, the apparatus does not provide an easily variable or realistic skiing experience for the user.

A windsurfing launch ramp assembly is disclosed in NL 9301043 A. The ramp assembly comprises an endless belt driven by a pair of rollers. The outer surface of the belt is provided with cantilevered brush-like elements, of a length sufficient to accommodate the fin or blade beneath a windsurfer. The belt is driven in the direction of the approaching windsurfer and is alleged to simulate a natural wave. While the apparatus of NL 9301943 is of use in providing an artificial launch means for a windsurfer, it is limited in its ability to accurately mimic a variety of surfaces.

Accordingly, there is a need for an improved means for providing an artificial slope for use with skis, a snowboard, or the like, that more closely mimics the surfaces and terrain that are encountered in a natural environment. In particular, there is a need for such a means that may be constructed to a wide range of sizes, that is, is readily scalable, to fit a wide range of locations.

SUMMARY OF THE INVENTION

The present invention provides a sporting facility comprising a plurality of rotary elements having flexible components extending therefrom, and means for effecting rotation of the rotary elements. The rotary elements are arranged so that the flexible components provide a substantially continuous supporting surface. In one embodiment, the rotary elements are in the form of wheels mounted on shafts. The wheels may be in the form of brushes mounted on the shafts, with the wheels/brushes on one of the shafts spaced from one another and located in the spaces between the wheels/brushes of adjacent shafts. The means for effecting rotation of the rotary elements may comprise motors connected to some of the shafts and arranged to drive the other shafts via belt drive systems. The presented surface afforded by the array of wheels/brushes may take a curvate form so as to afford a simulation wave.

BRIEF DESCRIPTION OF THE DRAWINGS

Reference now will be made in detail to embodiments of the disclosed invention, one or more examples of which are illustrated in the accompanying drawings wherein.

DETAILED DESCRIPTION OF THE EMBODIMENTS

In the sporting facility of the present invention, a substantially continuous surface is formed by the surfaces of a plurality of rotary elements. In this respect, the term 'substantially continuous surface' is a reference to the surface provided by a plurality of rotary elements disposed sufficiently close together such that a person using skis, a snowboard, a surfboard or the like, may travel across the surfaces of the rotary elements without undue restraint or problem, as if travelling across a continuous surface, such as that provided by snow, ice or water. It will be appreciated that the distance between adjacent rotary elements and their size are to be selected accordingly.

Referring to FIGS. 1 to 5, there is shown a sports facility, generally indicated as 2, according to a first embodiment of the present invention. The sports facility can be used for practicing surfing, snowboarding, skateboarding or skiing and the like. In this respect, the facility may be used for any activity that involves or requires a user to move or slide along or down a surface, in particular under the force of gravity, especially using an apparatus to contact the surface and on which the user stands, lies or sits.

Figure 1:
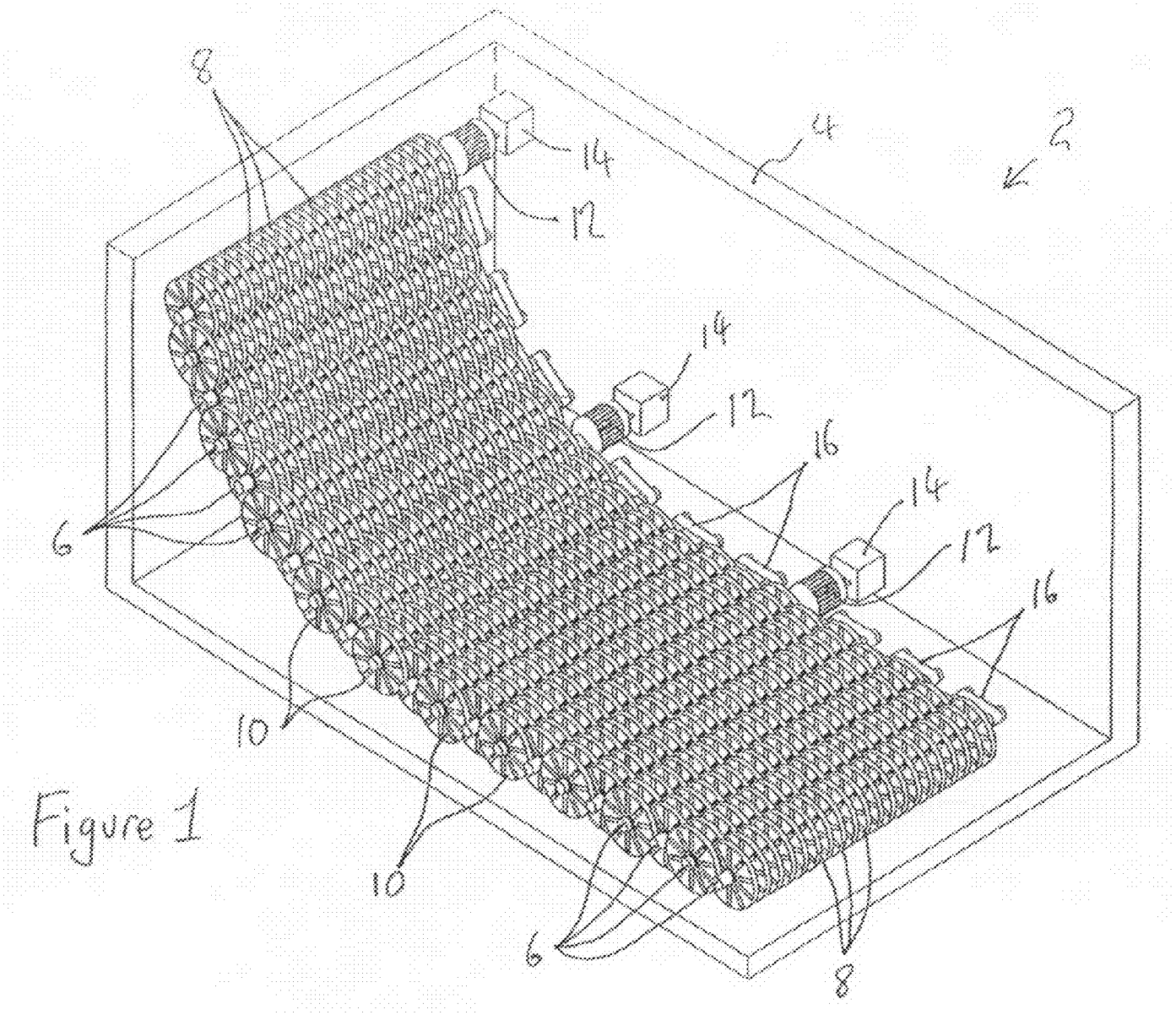
FIG. 1 is a perspective view of a part of a sports facility of a first embodiment of the present invention.
Figure 2:
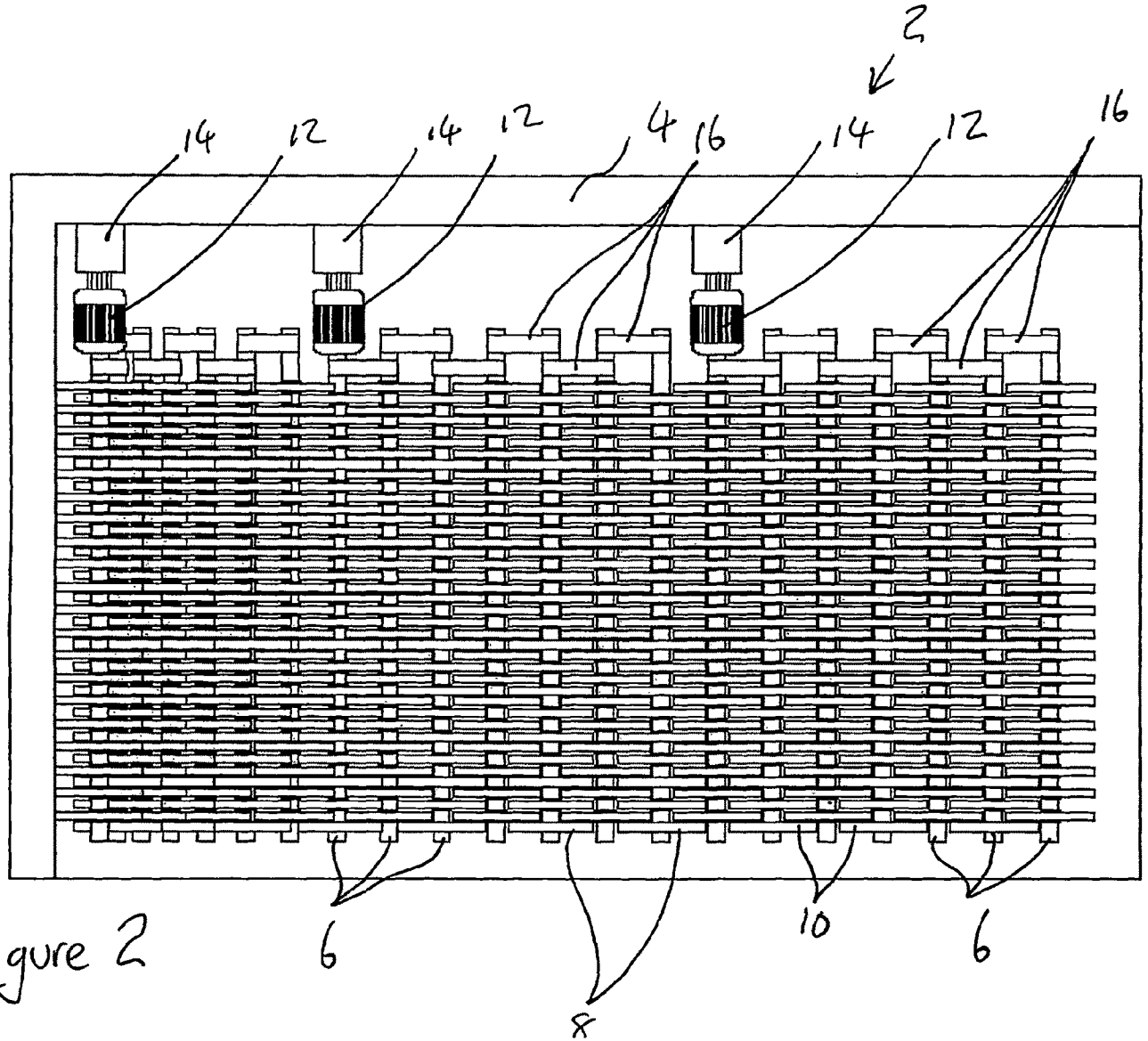
FIG. 2 is a plan view of the part of the sports facility shown in FIG. 1.
Figure 3:
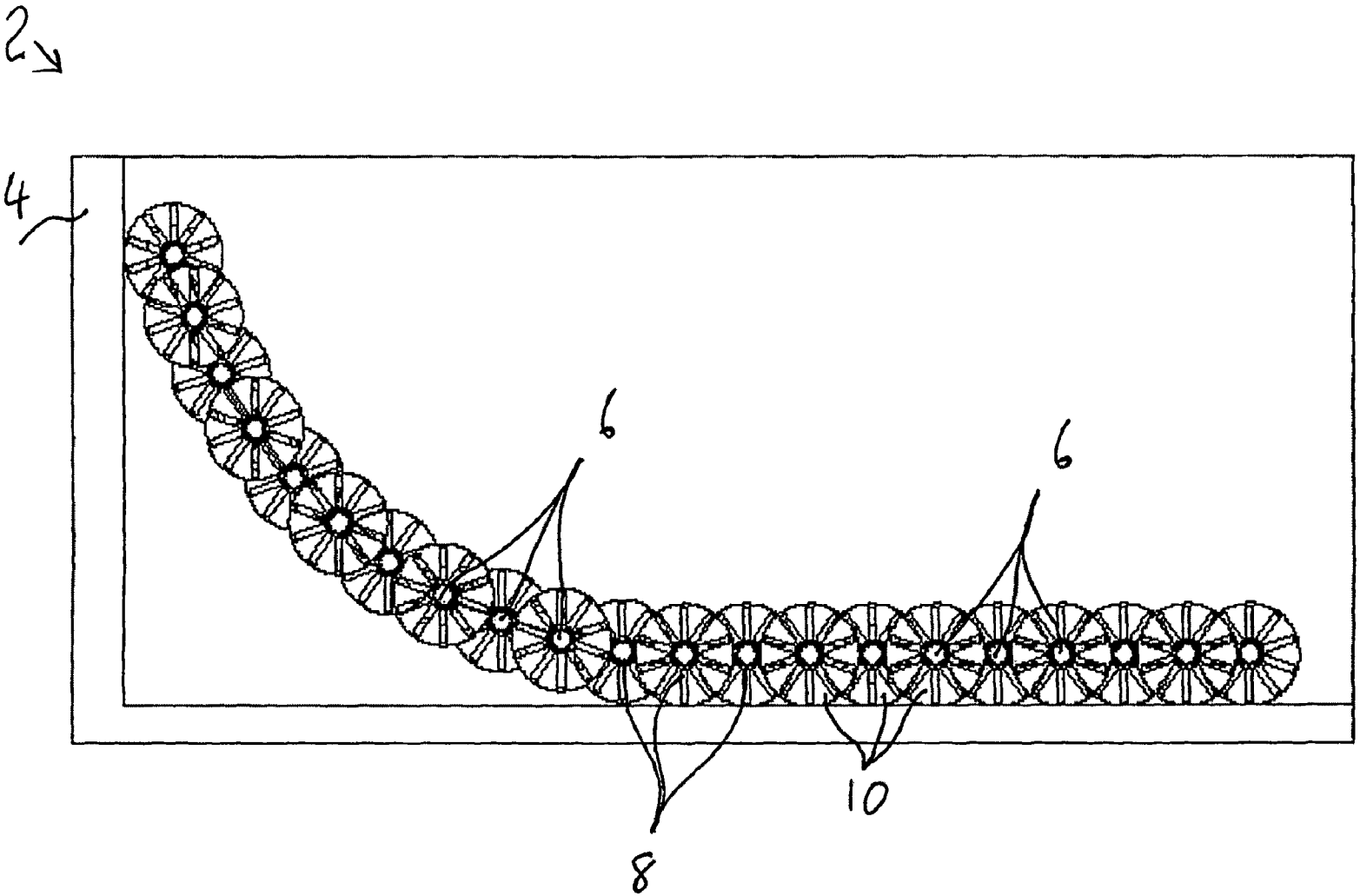
FIG. 3 is a side view of the part of the sports facility shown in FIG. 1.
Figure 4:
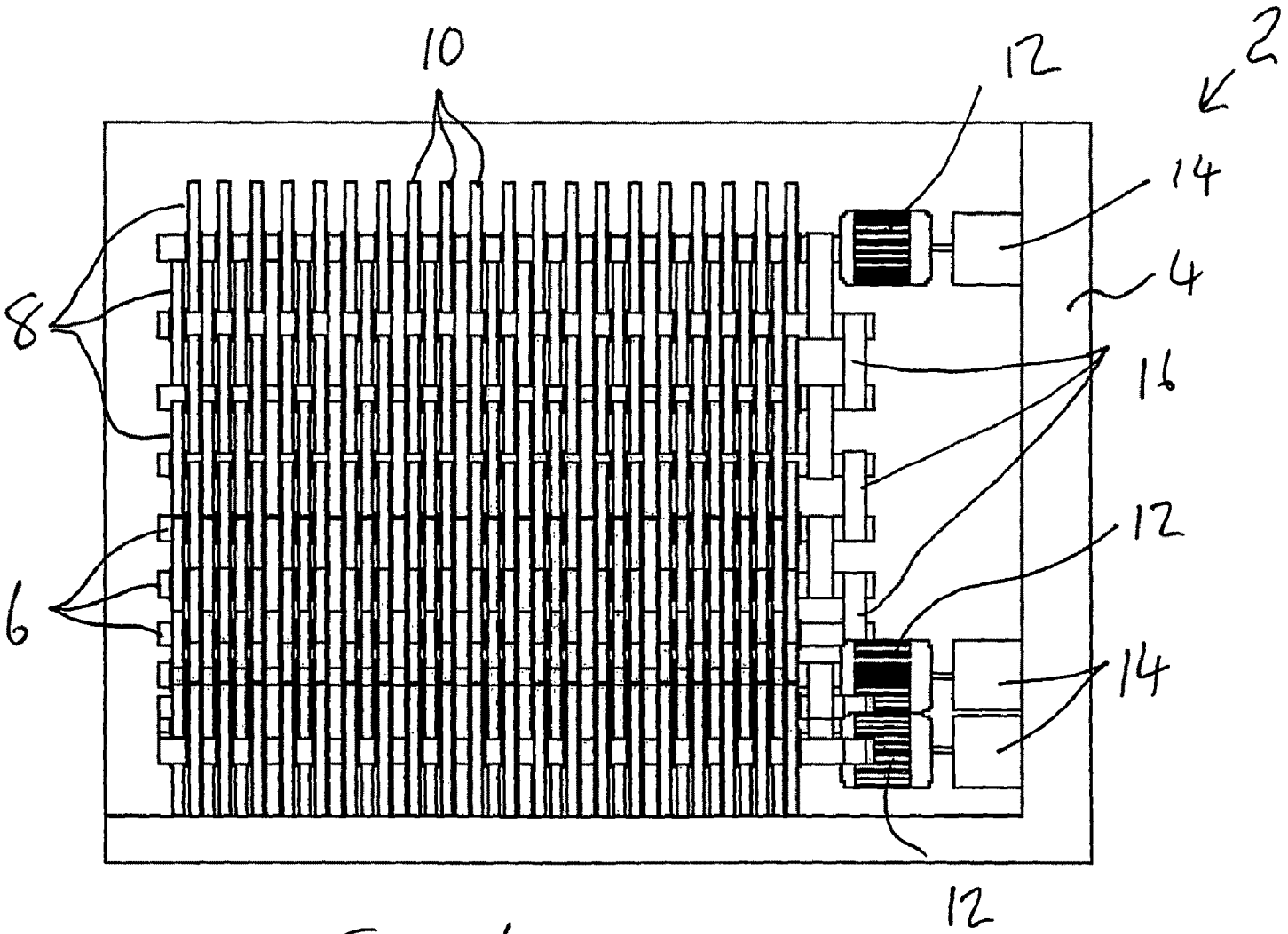
FIG. 4 is a front view of the sports facility shown in FIG. 1.
Figure 5:
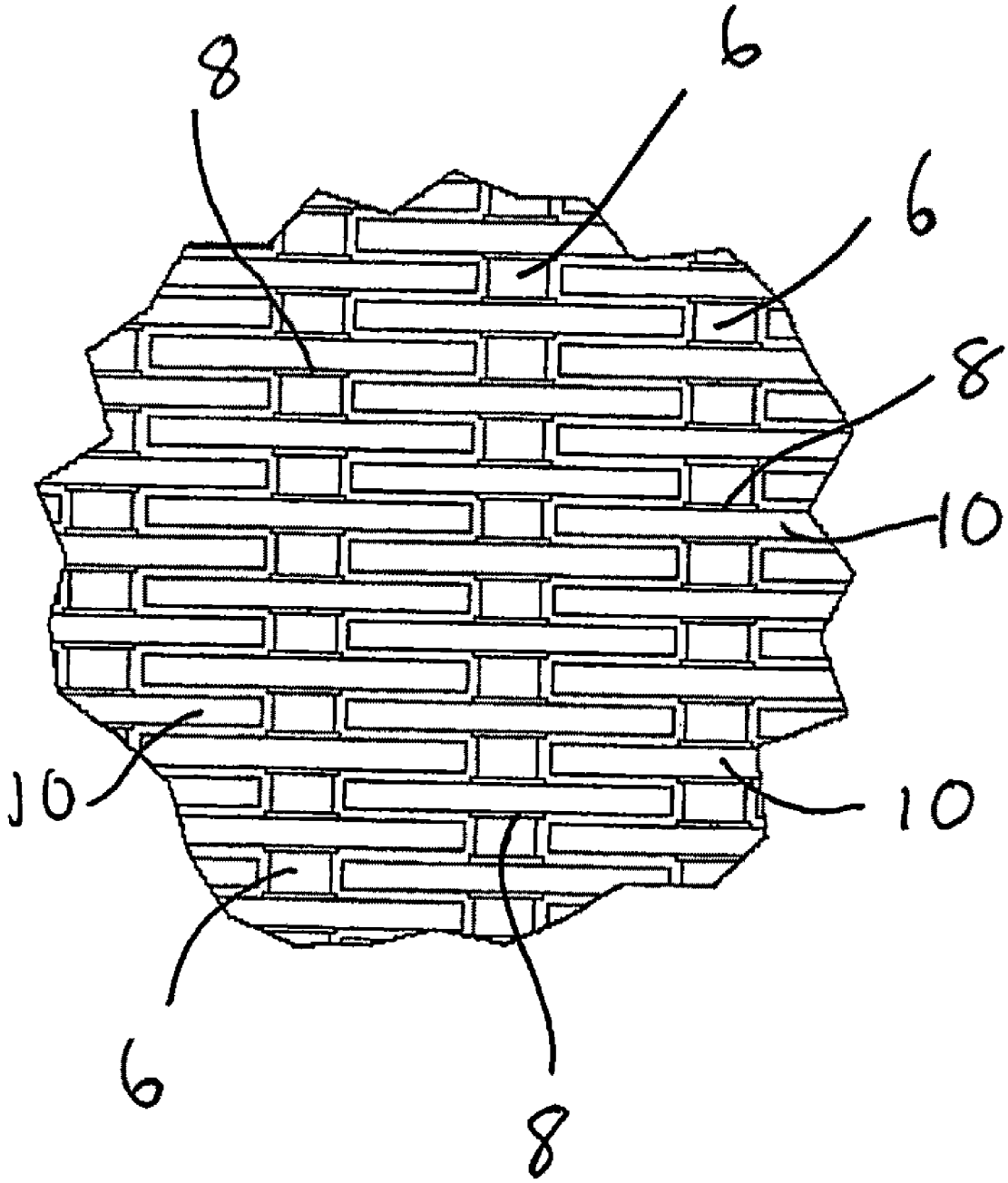
FIG. 5 is an enlarged portion of the plan view of FIG. 2.
Figure 6:
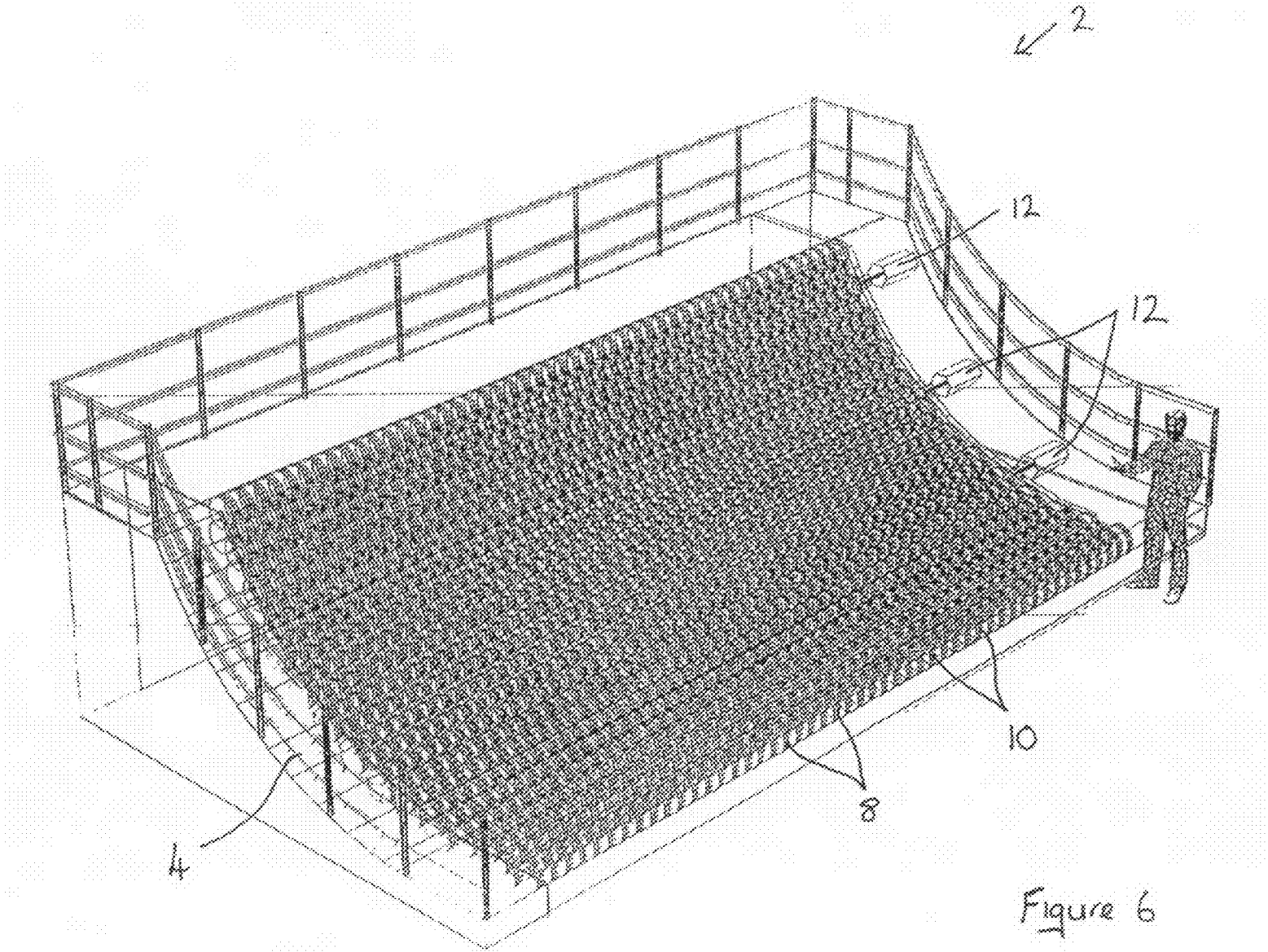
FIG. 6 of the drawings is a perspective view of a part of a sports facility of a second embodiment of the present invention.
Figure 7:
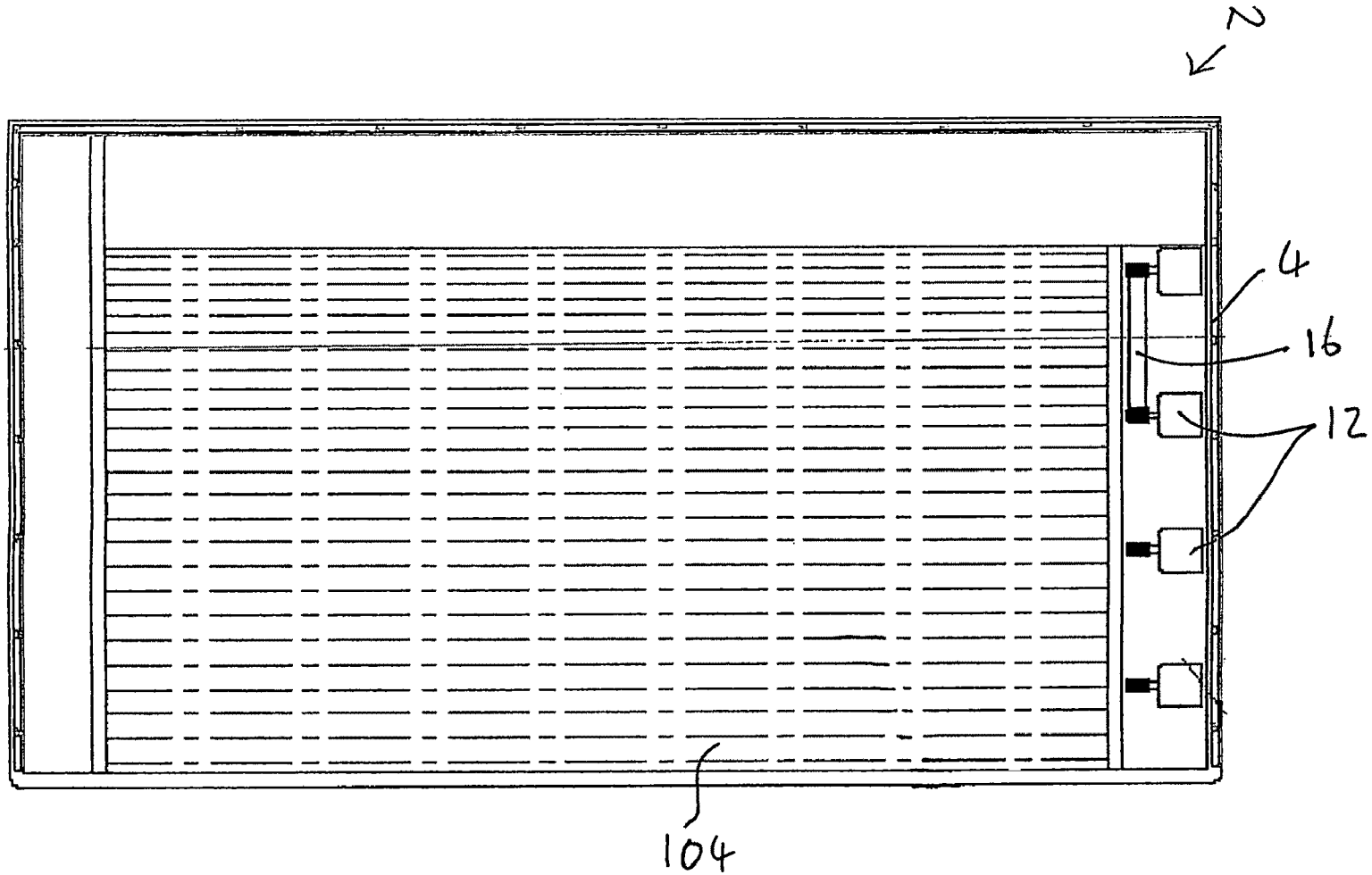
FIG. 7 is a plan view of the part of the sports facility shown in FIG. 6.
Figure 8:
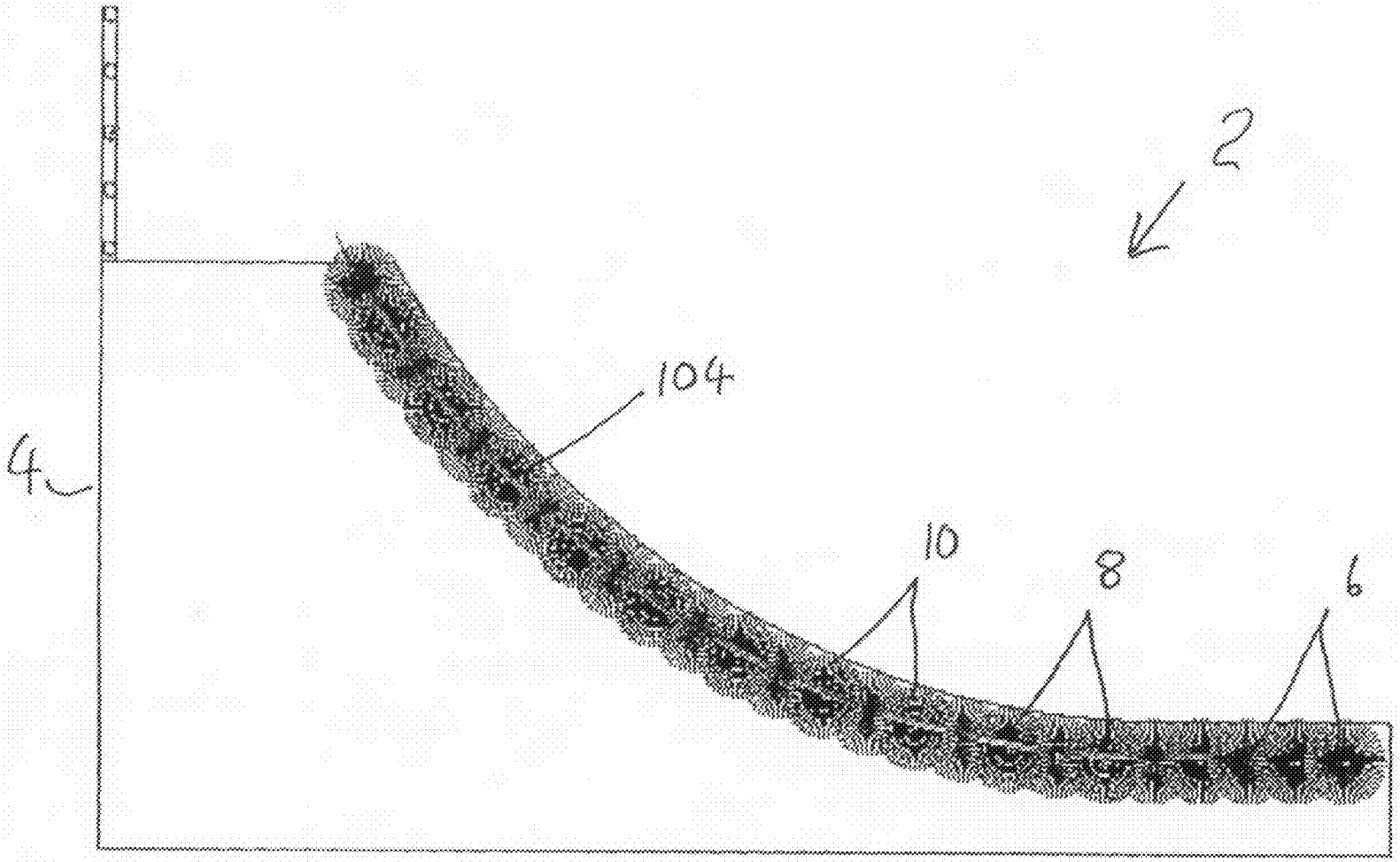
FIG. 8 is a side view of the part of the sports facility shown in FIG. 6.

The sports facility 2 comprises a supporting structure 4, such as a frame or the like. A plurality of shafts 6 are mounted on the supporting structure 4 in suitable bearings or the like (not shown for clarity) so as to be rotatable. The shafts 6 extend parallel to one another and are arranged in an arcuate or curved pattern, as shown in FIGS. 1 and 3. Each shaft 6 is provided with a plurality of rotary elements in the form of wheels 8, each wheel 8 being mounted on the respective shaft 6 for rotation therewith and extends perpendicular to the shaft. The wheels 8 are arranged on the shafts 6 such that the wheels of adjacent shafts are interdigitated, that is a wheel on one shaft extends into the space between two adjacent wheels extending from the adjacent shaft. This interdigitated pattern is shown in more detail in FIGS. 2 and 5.

Each wheel 8 is provided with a plurality of flexible components 10 extending radially outwards therefrom. The flexible components 10 are in the form of bristles, fibers, or the like, rendering the wheels 8 to act as brushes.

A drive means is provided to rotate the shafts 6. The drive means comprises electric motors 12, the operation of which is controlled by a respective inverter and speed control unit 14. The speed control unit may be controlled by a remote control device, such as a hand held device (not shown for clarity) using known technology. As shown in FIGS. 1 and 2, each motor 12 provides the drive for a plurality of shafts 6, with the drive being transmitted to the shafts by way of belts 16. Sprockets and/or chains may be used in the place of belts, as required. In other embodiments, each shaft 6 or wheel 8 may be driven by a separate motor 12, or a combination of motor configurations, each driving one or more shafts 6 or wheels 8, may be used.

In use, a person, for example using a snowboard, surfboard or skiis, moves over the upper portions of the flexible components 10 projecting from each wheel 8. The flexible components 10 contact the underside of the snowboard or ski and support the user, thus forming a substantially continuous surface over which the person can travel. Motion of the user is effected by gravity, as would be the case with a natural or real surface, such as a snow slope or a wave. The wheels are rotated by means of the motors. In use, the wheels and the flexible components extend and rotate perpendicular to the substantially continuous surface formed by the upper portions of the flexible components. The speed of rotation is selected to provide the desired properties to the surface. For example, the wheels may be rotated in the reverse direction of travel of the user (that is up the curved slope or counter clockwise in FIG. 2) thereby slowing the descent of the user and prolonging the time spent traversing the surface. The speed and/or direction of rotation may be varied in different portions of the slope, for example by rotating one or more shafts in a portion at a given speed, in order to vary the properties of the surface. For example, the steeper portion of the curved surface (that is the left hand portion in FIG. 2) may require the wheels to rotate faster, in order to hold the user steady, compared with the lower portion of the slope (that is the right hand portion in FIG. 2).

The embodiment shown in FIGS. 1 to 5 is particularly suitable for providing an artificial wave for use by surfers, body boarders and the like.

Turning to FIGS. 6 to 9, there is shown a second embodiment of the sports facility of the present invention, generally indicated as 102, having the same general construction and mode of operation to the embodiment of FIGS. 1 to 5. Accordingly, the same reference numerals have been used to identify components and features common to both embodiments and reference is made to the preceding description in respect of these common components and features.

Figure 9:
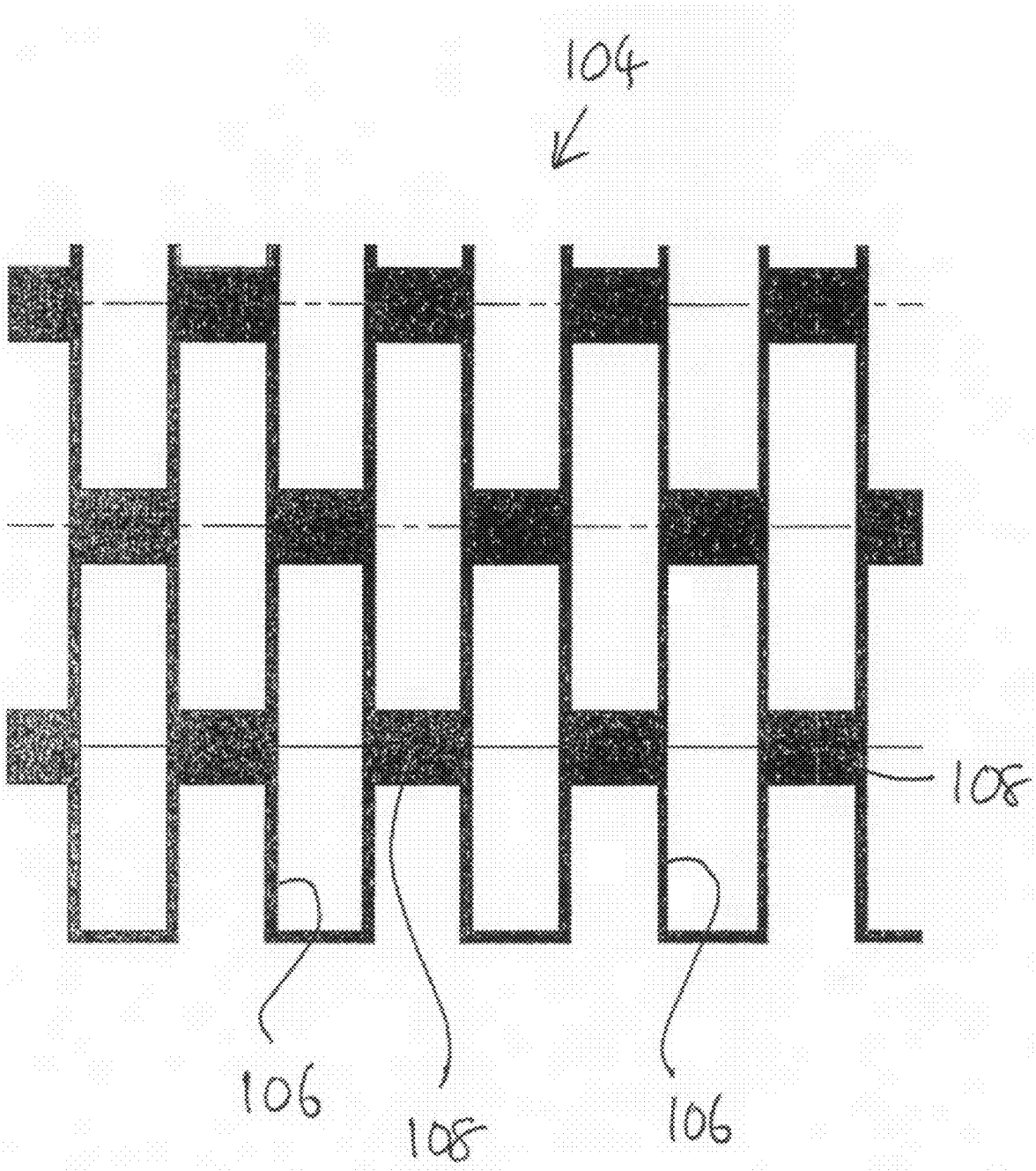
FIG. 9 is an enlarged portion of the plan view of FIG. 7.
Figure 1:
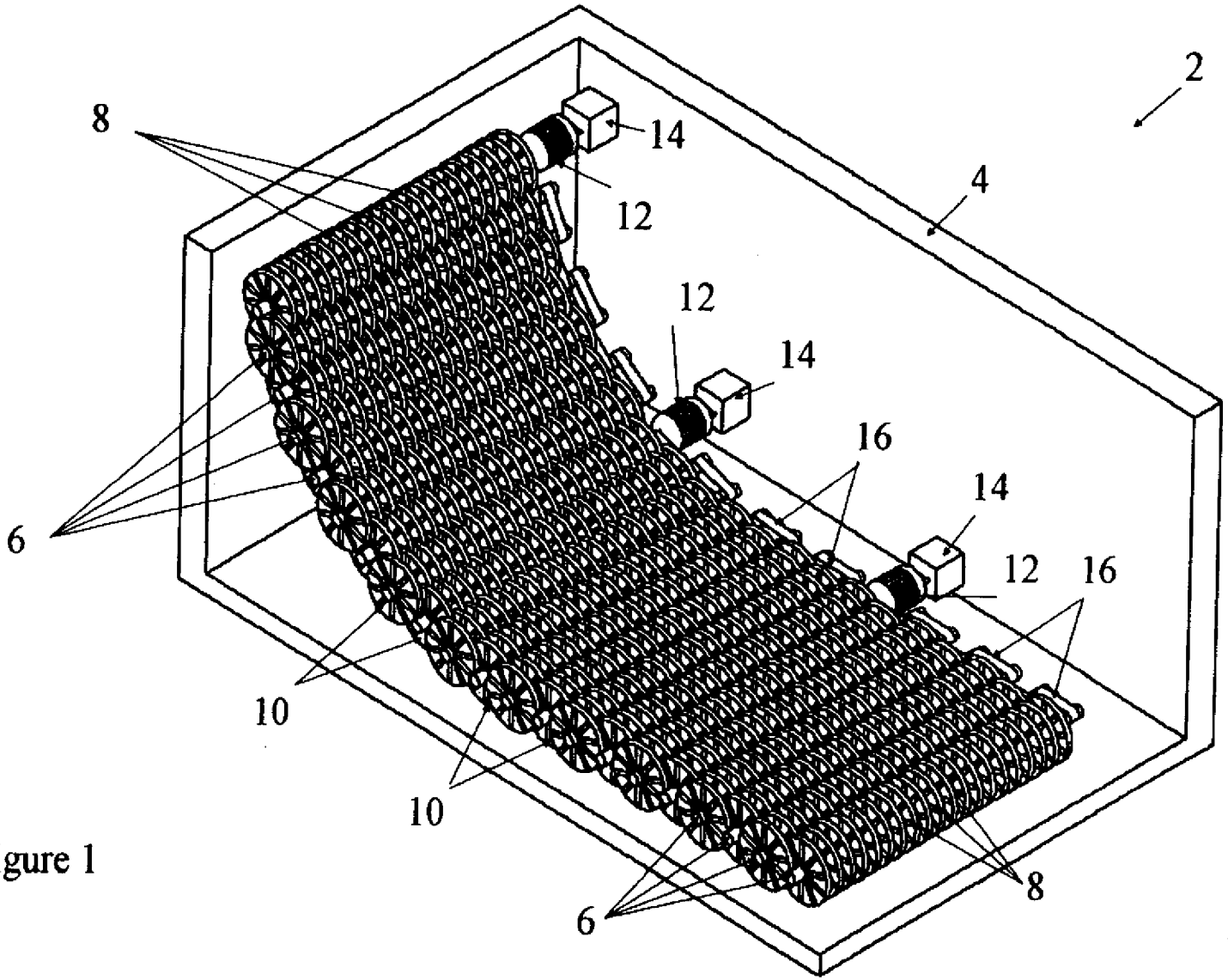
Figure 2:
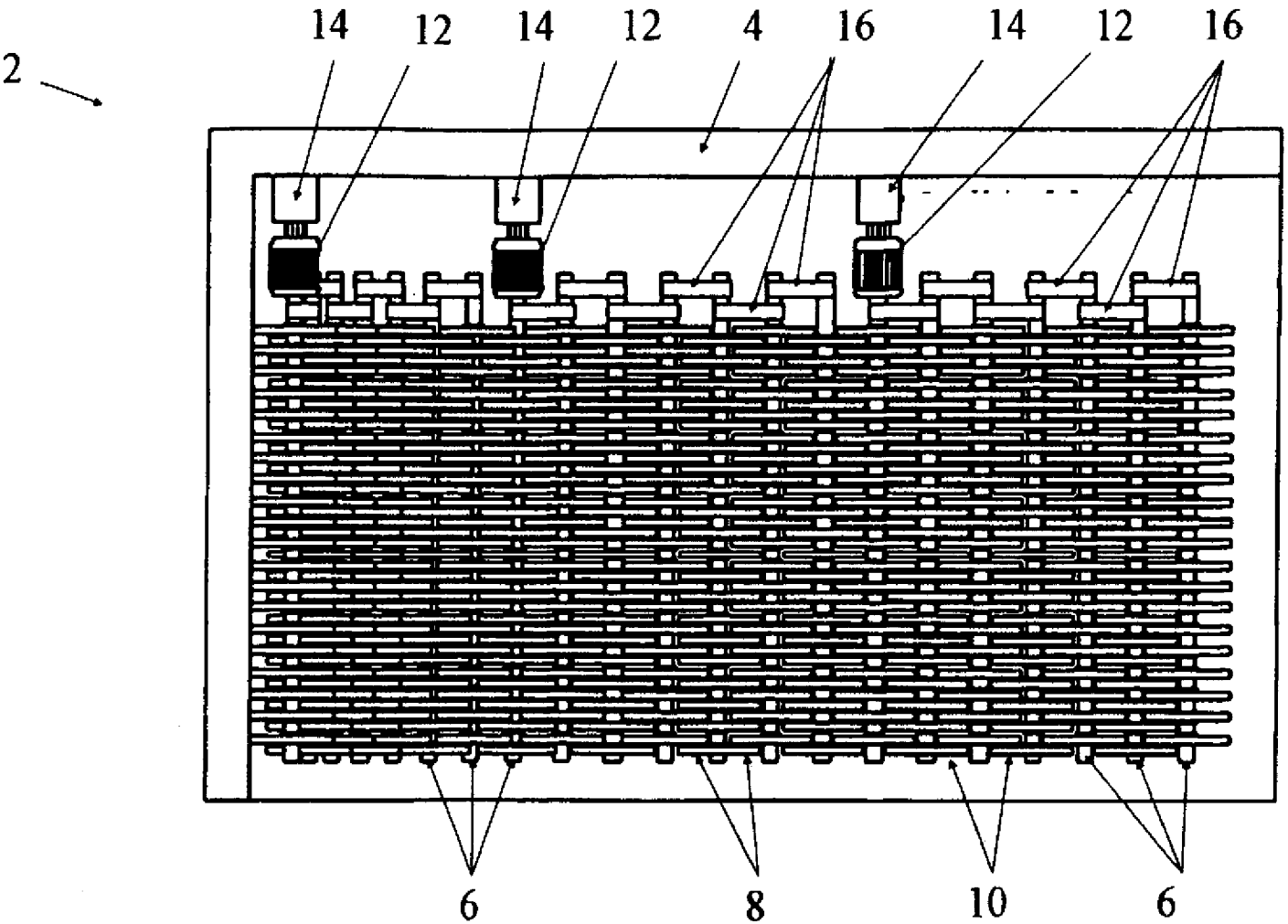
Figure 3:
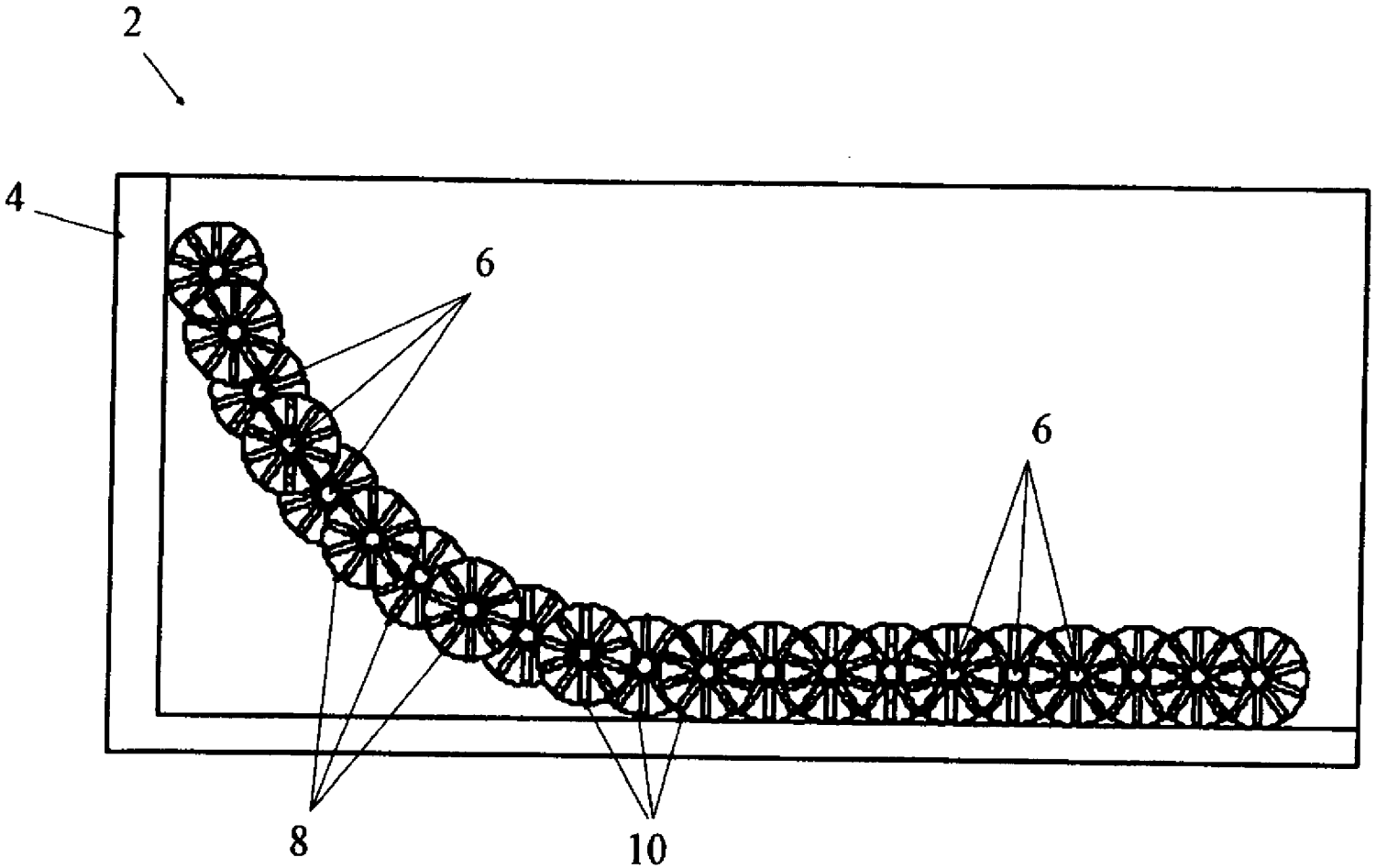
Figure 4:
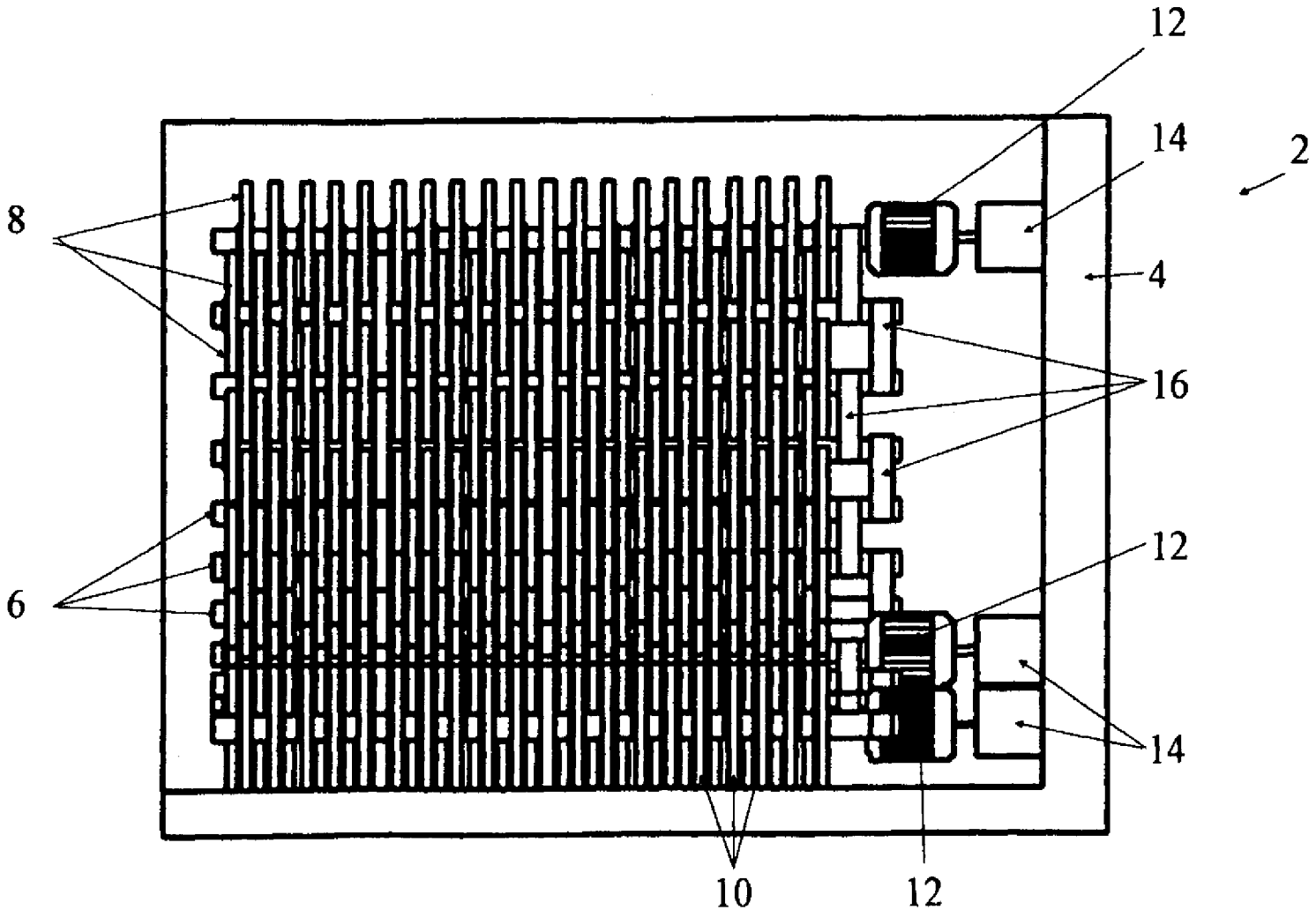
Figure 5:
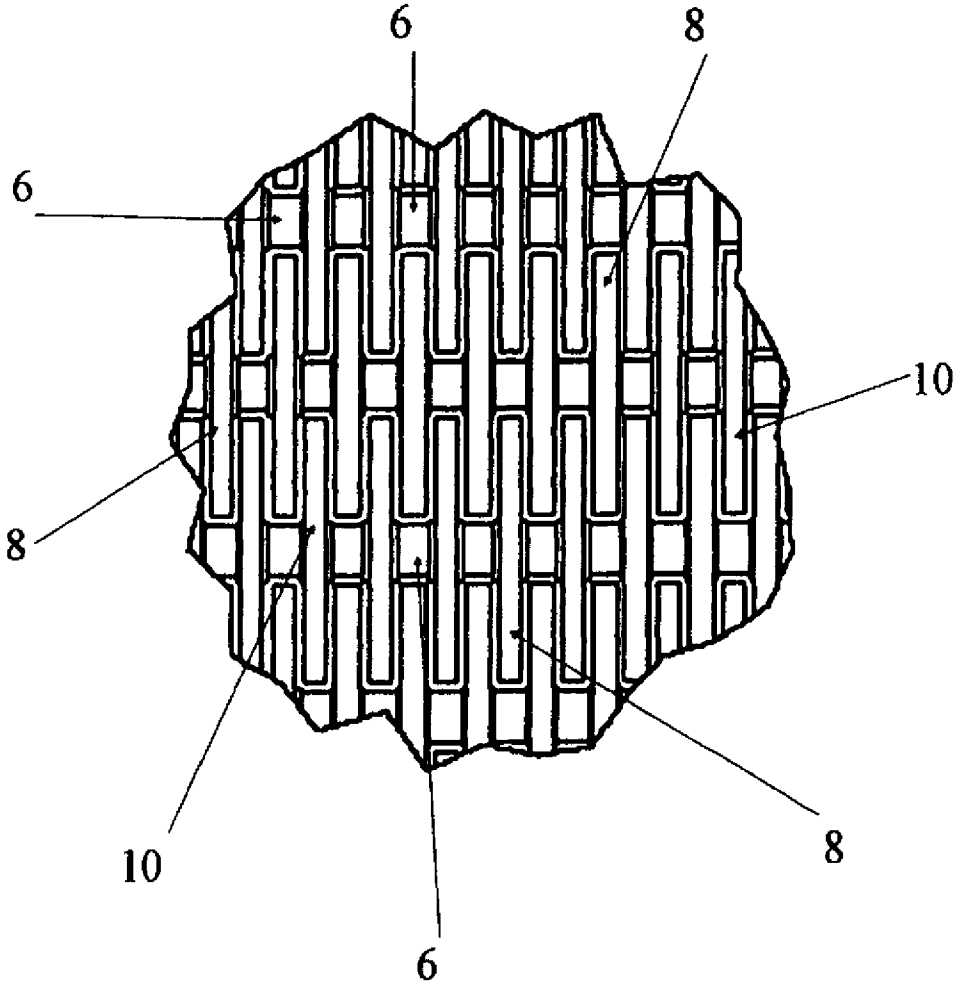
Figure 6:
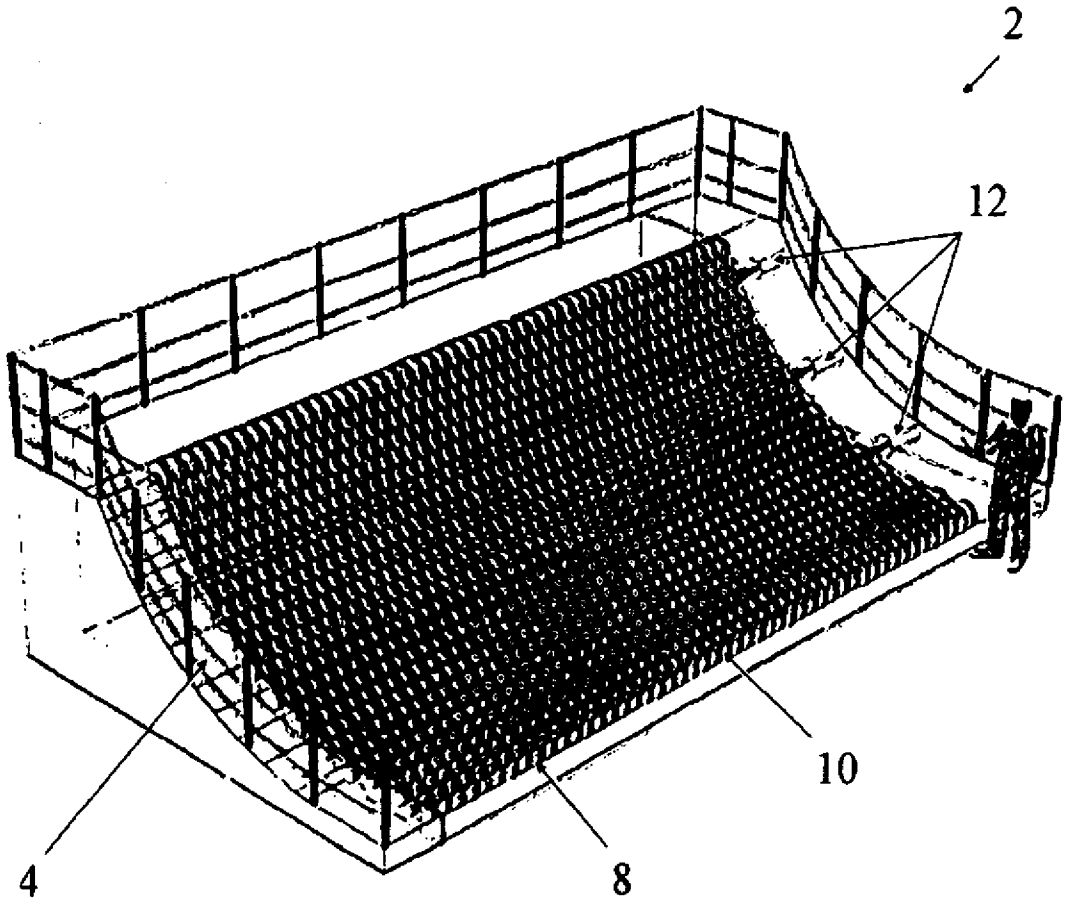
Figure 7:
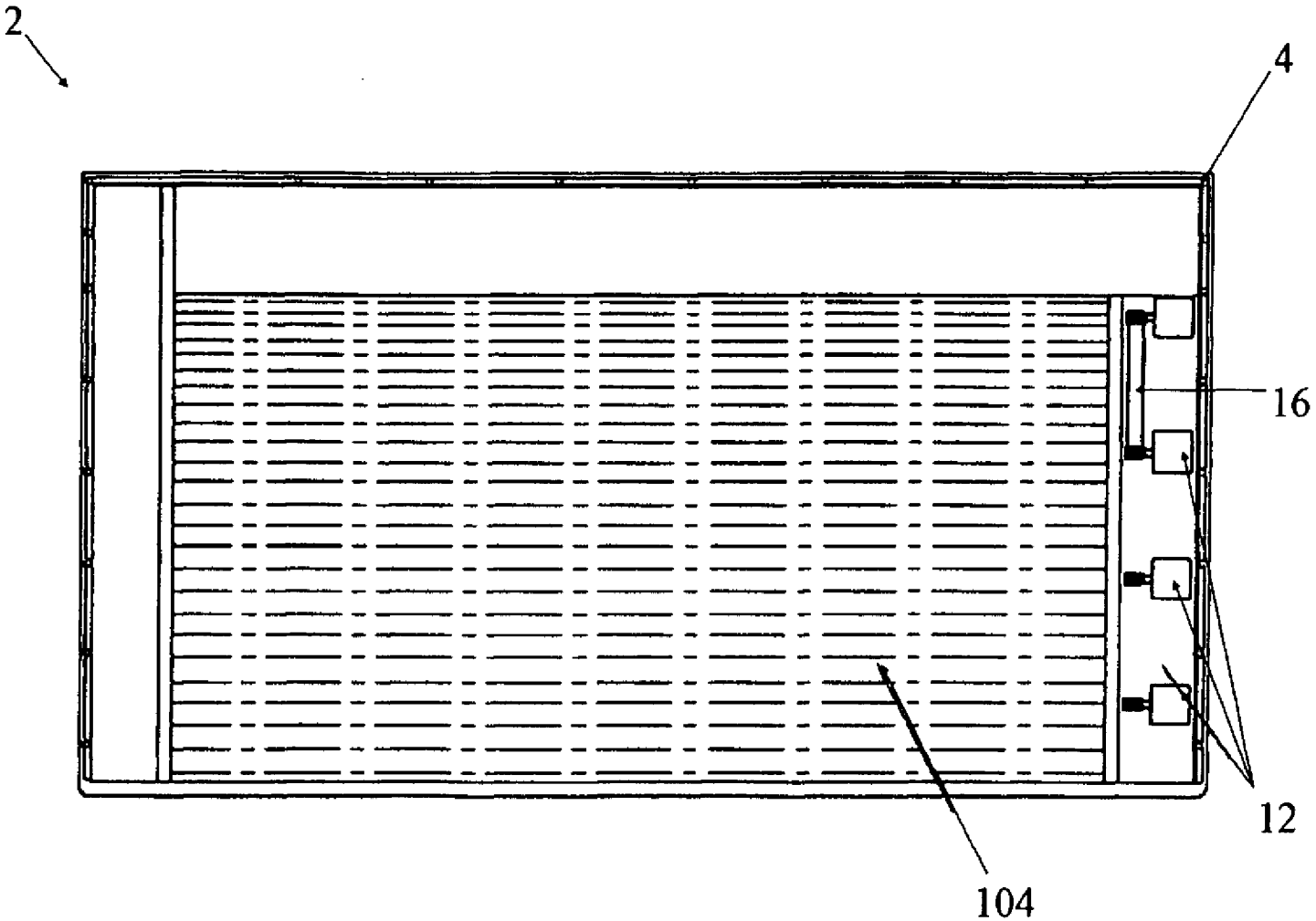
Figure 8:
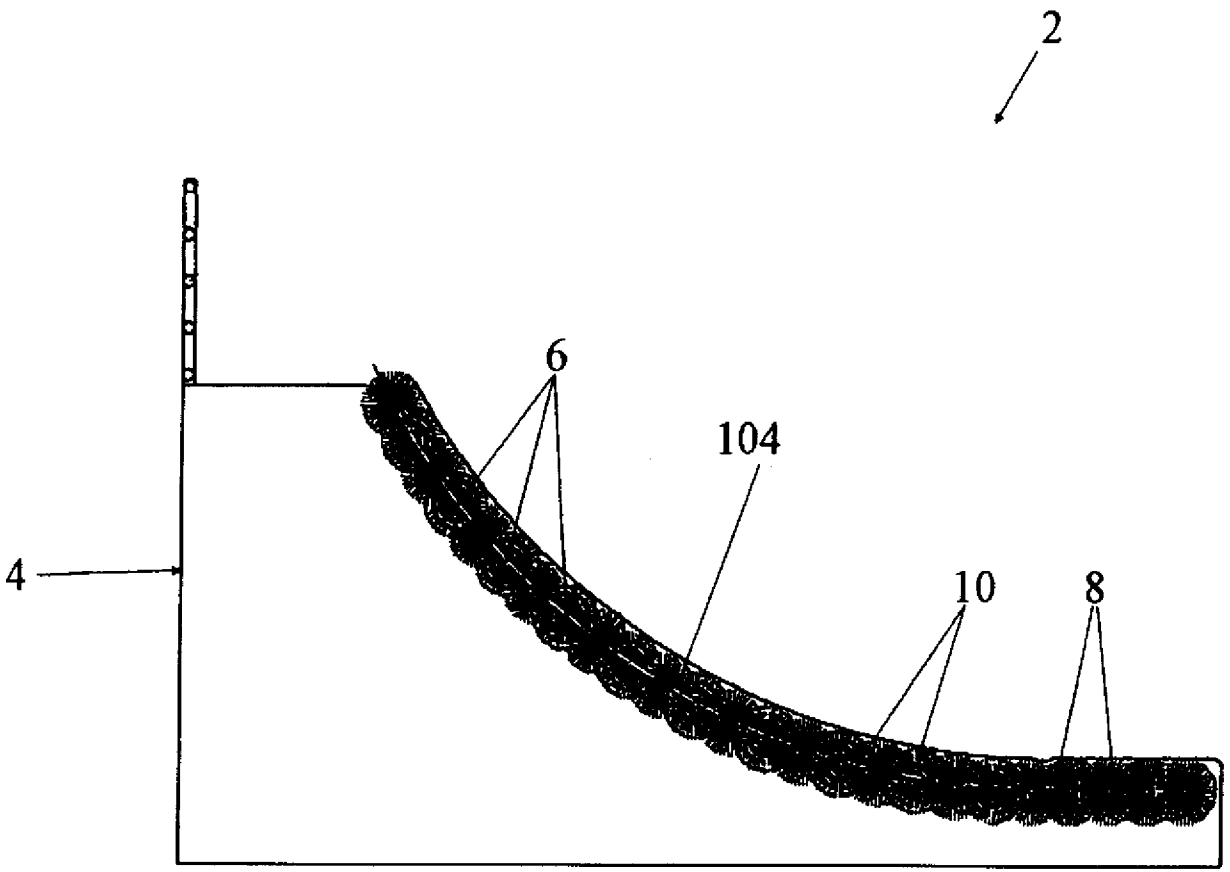
Figure 9:
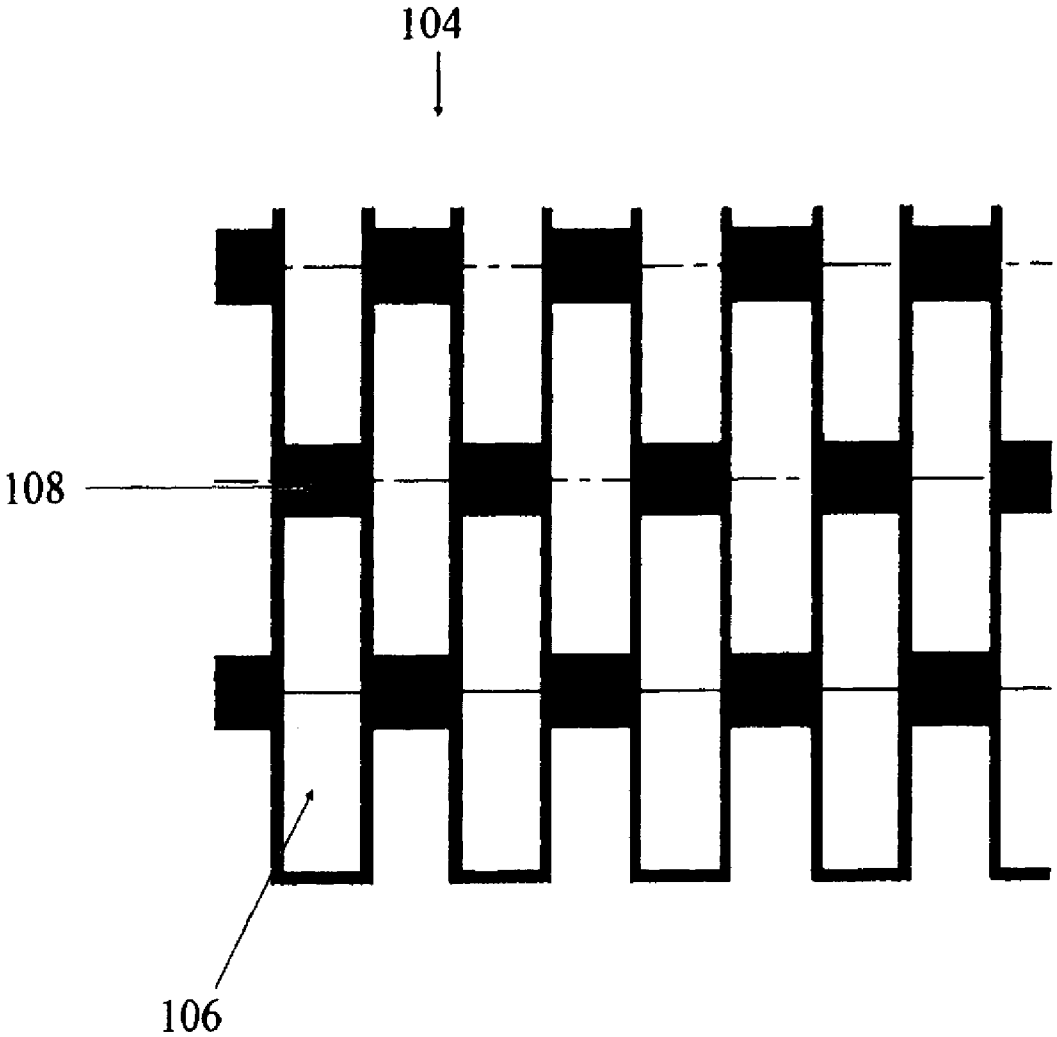

The embodiment of FIGS. 6 to 9 is provided with a protective member 104 extending over the uppermost part of the wheel/shaft assembly. The protective member 104 is shown in detail in FIG. 9 and comprises a plurality of apertures or openings 106 therein. As shown in FIG. 9, the apertures 106 are separated by lands 108. Each aperture 106 accommodates a single wheel/brush assembly, such that just the flexible components 10 of each wheel 8 extend through the aperture above the upper surface of the protective member 104. The apertures 106 are sized to closely fit the wheel/brush assembly, such that only a minimal clearance remains between the edges of each aperture 106 and the respective flexible components extending therethrough.

In use, the embodiment of FIGS. 6 to 9 functions as hereinbefore described. In general, the user would not contact the surface of the protective member 104. However, contact with the protective member 104 may occur, for example when executing a tight turn. In use, the protective member 104 serves to prevent the user from coming into contact with the substantial rotating components, such as the wheels and shafts, and prevents objects from passing between the wheels and shafts. This improves the overall safety of the sports facility.

It will be appreciated that the facility can occupy a substantially larger area than that shown in the drawings.

While the figures described above exemplify certain embodiments of the invention, other embodiments are possible. The rotary elements may be of any suitable form including rollers, discs, or wheels. The rotary elements may be made of any suitable material, such materials being well known in the art. Preferred materials include plastics, in particular Nylon™ Other suitable materials will be apparent to the person skilled in the art.

The rotary elements may be disposed to rotate at an angle to the substantially continuous surface, that is, in a plane at an angle to the surface, in particular perpendicular to the said surface. All of the rotary elements may be arranged to rotate at the same angle to the substantially continuous surface, for example all rotary elements rotating perpendicular to the surface. Alternatively, the rotary elements in one portion of the surface may be arranged to rotate at a first angle and the rotary elements in a second portion of the surface disposed at a second angle, different to the first. In this way, the properties of the surface as experienced by the user passing over the rotary elements may be varied from one portion to another.

The rotary elements may be arranged in any suitable pattern so as to generate the desired surface. For example, the rotary elements may be arranged in a plurality of rows, each row comprising a plurality of rotary elements. In one embodiment, the rows of rotary elements are arranged parallel to one another, that is, the longitudinal axes of the adjacent rows are parallel, over at least across a portion of the surface or the entire surface. In other embodiments, the rows may be arranged at an angle to one another, for example to provide different properties to portions of the surface.

The rows of rotary elements may be spaced apart by any suitable distance, provided that the rotary elements combine to provide a substantially continuous surface on which a user may ride using skis, a snow board, a surf board or the like. In one arrangement, the rotary elements of one row are disposed to extend into the spaces between the rotary elements of an adjacent row to form an interdigitated pattern. It has been found that this arrangement of interdigitated rotary elements provides a particularly advantageous assembly that is able to more accurately mimic a variety of natural surfaces and features, such as snow, ice, waves and the like. The interdigitated pattern may be such that a rotary element from one row is adjacent and between two rotary elements of the adjacent row. Alternatively, several rotary elements of one row, that is a block of elements, may be interposed between two blocks of the adjacent row. Again, the pattern of interdigitation may be used to vary the properties of the surface.

As noted hereinbefore, the rotary elements of this aspect of the invention are provided with flexible components extending therefrom, the surface of the flexible components defining the substantially continuous surface. In use, the flexible components are contacted by the skis or board of the user. The properties of the surface and the experience of the user are determined by the flexibility of the flexible components, their shape and the speed of rotation of the rotary elements. In one embodiment, the flexible components are in the form of bristles, filaments or fibers. In this case, the rotary elements act as rotating brushes.

The rotary elements may have any suitable cross sectional shape, such as circular or rectangular. The precise cross-sectional shape may be selected to provide the desired properties from the substantially continuous surface.

The filaments or fibers may have any suitable length and diameter. In a particular embodiment, the filaments or fibers have a diameter of from 0.1 to 5 mm; in another embodiment the diameter ranges from 0.25 to 2.5 mm. For a given material, filaments having a larger diameter will be stiffer and yield and flex less under the weight of the user. In this way, the properties of the surface may be varied. The facility may employ filaments or fibers of the same diameter. Alternatively, the flexible components of the rotary elements in a first portion of the substantially continuous surface have a first diameter and the flexible components of the rotary elements in a second portion of the substantially continuous surface have a second diameter, different to the first diameter, in order to provide a variation in the properties of the surface in different portions. The length of the filaments or fibers will also vary the properties of the surface. The filaments or fibers may range from 30 to 200 mm in length, including a range of 50 to 100 mm in one embodiment. Similarly dimensions may be applied to flexible elements of other shapes and designs.

The substantially continuous surface may be planar in whole or in part. Alternatively, the rotary elements are disposed to form a surface having at least a portion that is curvilinear. The presented surface afforded by the array of rotary elements, such as wheels/brushes, may take, for example, a curvate form so as to afford a simulation wave.

Means are provided to rotate the rotary elements. Suitable means are known in the art and include motors, in particular electric motors. The rotary elements may be mounted so as to be rotated individually. Alternatively, a plurality of rotary elements may be mounted on a single shaft, the rotation of which effects rotation of all of the plurality of rotary elements. Each rotary element or, if used, each shaft may be driven directly by a respective motor, with or without a suitable gear assembly or the like. Alternatively, a single motor may be employed to rotate a plurality of rotary elements or, if employed, shafts. In such a case, the drive may be transmitted by any suitable means, for example one or more of chains, belts, or sprockets. In yet another embodiment, the rotary elements may be freely rotational.

The drive means may be arranged to rotate all the rotary elements at the same speed. An alternative embodiment is one wherein the means for rotating the rotary elements are adapted to rotate the rotary elements in a first portion of the substantially continuous surface at a first speed and to rotate the rotary elements in a second portion of the substantially continuous surface at a second speed, different to the first speed. In this way, variations in the speed of rotation may be used to vary the properties of different portions of the surface.

The rotary elements may be arranged to rotate in the same direction. Alternatively, the drive means may be adapted to rotate the rotary elements in a first portion of the substantially continuous surface in one direction and the rotary elements in a second portion of the said surface in the opposite direction.

The facility may present the rotary elements to the user to form the substantially continuous surface. Optionally, a protective member extending over the rotary elements may be provided, the protective element being provided with a plurality of openings therein, flexible components of each rotary element extending through an opening in the protective member. In this way, only the flexible components are presented to the user and exposed. Proper sizing of the apertures to closely match the rotary elements will allow the protective member to prevent the user from being harmed by contact with the rotary elements, the shafts if used, and the drive means, for example in the event of a fall.

The facility may further comprise a control system for controlling the operation of the means for rotating the rotary elements, for example their speed and direction of rotation. In one embodiment the control system comprises a control device for use by an operator, the control device being remote from the control system and the sporting facility. The control device may take the form of a hand-held device, capable of being held by a person using the sporting facility. The hand-held device may be arranged with a switch that activates the facility while being held and deactivates the facility when released. In this way, the user may release the control device in the event of a fall, which will stop the rotation of the rotary elements, in turn improving safety of the system. In yet further embodiments, the means for rotating the rotary elements and/or the rotary elements themselves are provided with means for effecting an emergency stop, such as a braking means or the like.

The invention thus provides a sports facility that enables participants of a number of sports to practice safely.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

What is claimed is:

1. A sporting facility comprising:

a plurality of shafts;

a plurality of rotary elements mounted on the shafts, wherein the rotary elements comprise flexible components extending therefrom; and a drive means coupled to the plurality of shafts;

wherein the rotary elements are arranged so that the flexible components provide a substantially continuous supporting surface.

2. The sporting facility of claim 1, wherein the rotary elements are wheels.

3. The sporting facility of claim 1, wherein the supporting surface is curvilinear.

4. The sporting facility of claim 1, wherein the flexible components are selected from the group consisting of filaments, bristles, and fibers.

5. The sporting facility of claim 4, wherein the rotary elements act as brushes.

6. The sporting facility of claim 1, further comprising a plurality of drive means, wherein each drive means is coupled to at least one shaft of the plurality of shafts.

7. The sporting facility of claim 1, wherein the drive means is coupled to the plurality of shafts with belts.

8. The sporting facility of claim 1, wherein the rotary elements rotate in a plane perpendicular to the substantially continuous surface.

9. The sporting facility of claim 1, wherein a first portion of the plurality of rotary elements rotates at a first speed, and wherein a second portion of the plurality of rotary elements rotates at a second speed.

10. The sporting facility of claim 9, further comprising more than one drive means, wherein a first drive means causes the first portion of the plurality of rotary elements to rotate at the first speed, and wherein a second drive means causes the second portion of the plurality of rotary elements to rotate at a second speed.

11. A sporting facility comprising:

a plurality of shafts;

a plurality of rotary elements mounted on the shafts, wherein the rotary elements comprise flexible components extending therefrom; and a drive means coupled to the plurality of shafts;

wherein the rotary elements are arranged so that the flexible components provide a substantially continuous supporting surface, and wherein the rotary elements are arranged in an interdigitated pattern.

12. The sporting facility of claim 11, wherein the shafts are arranged in rows, and wherein the interdigitated pattern is formed by rotary elements of one row extending between rotary elements in a second row.

13. The sporting facility of claim 11, further comprising a protective member over the rotary elements, wherein the protective member comprises a plurality of openings, and wherein the flexible components of each rotary element extend through an opening in the protective member.

14. A method of constructing a sports facility, comprising:

providing a plurality of shafts;

mounting a plurality of rotary elements to the plurality of shafts, wherein the rotary elements have flexible elements extending therefrom;

coupling the plurality of shafts to a drive means; and arranging the rotary elements so that the flexible elements provide a substantially continuous supporting surface.

15. The method of constructing a sports facility of claim 14, wherein the rotary elements comprise wheels.

16. The method of constructing a sports facility of claim 14, wherein the step of coupling comprises coupling the plurality of shafts to the drive means with belts.

17. The method of constructing a sports facility of claim 14, further comprising coupling a first portion of the plurality of shafts to a first drive means, and coupling a second portion of the plurality of shafts to a second drive means.

18. A method of constructing a sports facility, comprising:

providing a plurality of shafts;

mounting a plurality of rotary elements to the plurality of shafts, wherein the rotary elements have flexible elements extending therefrom;

coupling the plurality of shafts to a drive means; and arranging the rotary elements so that the flexible elements provide a substantially continuous supporting surface;

wherein the step of arranging comprises placing the rotary elements in an interdigitated pattern.

19. The method of constructing a sports facility of claim 18, wherein the interdigitated pattern is formed by placing the shafts in rows, and wherein the rotary elements of one row extend between the rotary elements in a second row.

20. The method of constructing a sports facility of claim 18, further comprising placing a protective member over the plurality of rotary elements, wherein the protective member comprises a plurality of openings, and wherein the flexible components of each rotary element extend through an opening in the protective member.

* * * * *

UNITED STATES PATENT AND TRADEMARK OFFICE

CERTIFICATE OF CORRECTION

PATENT NO. : 7,942,751 B2
APPLICATION NO. : 12/303962
DATED : May 17, 2011
INVENTOR(S) : Dent It is certified that error appears in the above-identified patent and that said Letters Patent is hereby corrected as shown below:

The Title page, showing the illustrative figure, should be deleted and substitute therefor the attached Title page.

Delete figs. 1-9 and substitute therefor the drawing sheets, consisting of figs. 1-9 as shown on the attached pages.

Signed and Sealed this
Twenty-sixth Day of July, 2011

David J. Kappos

David J. Kappos
*Director of the United States Patent and Trademark Office*

(12) United States Patent
Dent

(10) Patent No.: US 7,942,751 B2
(45) Date of Patent: May 17, 2011

(54) SPORTS FACILITY

(76) Inventor: Kyle Graham John Dent, Devon (GB)

( * ) Notice: Subject to any disclaimer, the term of this patent is extended or adjusted under 35 U.S.C. 154(b) by 248 days.

(21) Appl. No.: 12/303,962

(22) PCT Filed: Jun. 8, 2007

(86) PCT No.: PCT/GB2007/002136

§ 371 (c)(1), (2), (4) Date: Dec. 9, 2008

(87) PCT Pub. No.: WO2007/141546

PCT Pub. Date: Dec. 13, 2007

(65) Prior Publication Data

US 2010/0130297 A1 May 27, 2010

(30) Foreign Application Priority Data

Jun. 9, 2006 (GB) ..... 0611384.9

(51) Int. Cl.
*A63C 19/10* (2006.01)
*A63C 19/00* (2006.01)

(52) U.S. Cl. ..... 472/91; 482/71

(58) Field of Classification Search ..... 472/88–91; 14/69.5, 70; 482/70, 71

See application file for complete search history.

(56) References Cited

U.S. PATENT DOCUMENTS

| | | | | |
|---|---|---|---|---|
| 3,251,596 | A | 5/1966 | Fukusaburo | |
| 4,087,088 | A | 5/1978 | Keiso | |
| 4,423,864 | A * | 1/1984 | Wiik | 472/91 |
| 5,018,721 | A * | 5/1991 | Nagahisa | 472/91 |
| 5,647,804 | A * | 7/1997 | Homma et al. | 472/90 |
| 5,951,357 | A * | 9/1999 | Mandle et al. | 446/138 |
| 7,513,832 | B2 * | 4/2009 | Gallagher | 472/89 |

FOREIGN PATENT DOCUMENTS

| | | |
|---|---|---|
| EP | 0384383 | 8/1990 |
| FR | 1418835 | 11/1965 |
| FR | 2757415 | 6/1998 |
| GB | 2288544 | 10/1995 |
| GB | 2365787 | 2/2002 |
| NL | 9301043 | 6/1993 |
| WO | 95/28997 | 11/1995 |
| WO | 2006/017971 | 2/2006 |

* cited by examiner

*Primary Examiner* — Kien T Nguyen

(74) *Attorney, Agent, or Firm* — The Mueller Law Office, P.C.

(57) ABSTRACT

A sporting facility comprises a plurality of rotary elements having flexible components extending therefrom, the rotary elements being arranged so that the flexible components thereof provide a substantially continuous supporting surface, and means for rotating the rotary elements. The flexible components are preferably filaments or fibers, extending perpendicular to the substantially continuous surface. The facility is of particular use in providing an artificial surface for skiing, snow boarding, surfing or the like.

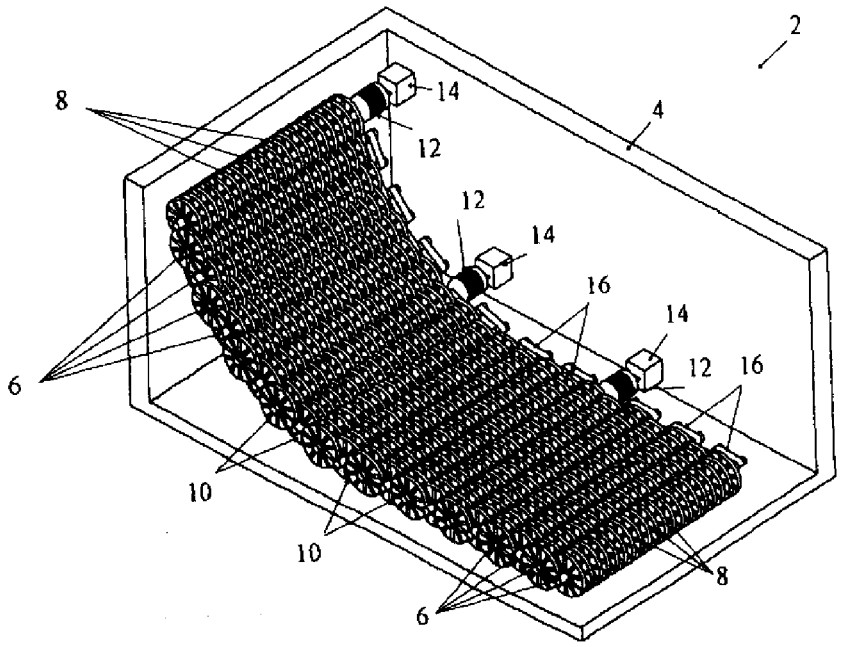

20 Claims, 9 Drawing Sheets